US005795277A

United States Patent [19]

Bruntmyer

[11] Patent Number: 5,795,277

[45] Date of Patent: Aug. 18, 1998

[54] TILT WALKER SPORT BOARD SPORT TILT WALKER BOARD

[75] Inventor: Joseph A. Bruntmyer, Rte. 11, Box 1486, Hickory, N.C. 28601

[73] Assignee: Joseph A. Bruntmyer, Hickory, N.C.

[21] Appl. No.: 492,220

[22] Filed: Jun. 19, 1995

Related U.S. Application Data

[63] Continuation-in-part of Ser. No. 85,977, Jun. 30, 1993, abandoned.

[51] Int. Cl.[6] ..... A63B 22/14

[52] U.S. Cl. ..... 482/146; 482/77; 482/79

[58] Field of Search ..... 482/51, 79, 80, 482/77, 105, 146, 147; 472/14, 25, 26; 135/82, 86

[56] References Cited

U.S. PATENT DOCUMENTS

| | | | |
|---|---|---|---|
| 1,565,484 | 12/1925 | McWhirter | 482/146 |
| 2,726,845 | 12/1955 | Hyslop, Jr. et al. | 482/146 |
| 2,941,801 | 6/1960 | Pedersen | 482/146 |
| 3,024,021 | 3/1962 | Coplin et al. | 482/146 |
| 3,567,242 | 3/1971 | Miller | 482/147 |
| 3,954,279 | 5/1976 | Guerr | 482/77 |
| 4,613,131 | 9/1986 | Anderson | 482/146 |
| 4,700,947 | 10/1987 | Heatwok | 482/146 |
| 4,705,272 | 11/1987 | Rupprecht | 482/77 |
| 4,759,542 | 7/1988 | Hudec | 482/146 |
| 4,787,630 | 11/1988 | Waston et al. | 482/146 |
| 5,080,382 | 1/1992 | Franz | 482/77 |
| 5,178,596 | 1/1993 | McIntire | 482/80 |
| 5,292,296 | 3/1994 | Davignon | 487/146 |
| 5,352,176 | 10/1994 | Huang | 482/146 |

FOREIGN PATENT DOCUMENTS

| | | | |
|---|---|---|---|
| 510998 | 5/1957 | Italy | 482/146 |
| 7901529 | 8/1980 | Netherlands . | |
| 609869 | 3/1979 | Switzerland | 482/146 |

*Primary Examiner*—Jeanne M. Clark

[57] ABSTRACT

An improved recreational device of skill and balance, having an elongated base, a pair of downwardly projecting feet which are spaced apart, and on the inboard side of spaced footrests on the upper face of the board, the feet being rotatable about a vertical axis, and preferably being a resilient material. An optional rope or J-hook is also provided to engage with the center of the board. Methods for using the apparatus are also disclosed.

6 Claims, 4 Drawing Sheets

TILT WALKER SPORT BOARD SPORT TILT WALKER BOARD

This application is a continuation-in-part of application Ser. No. 08/085,977 filed Jun. 30, 1993, now abandoned.

FIELD OF THE INVENTION

The present invention relates to a recreational device of skill and balance, and more particularly to a sports board apparatus having two resilient supporting swivel pads.

BACKGROUND OF THE INVENTION

Over the years, recreational games of balance have proved extremely popular with people of all ages. Devices which have embodied these attributes include surf boards, skate boards, unicycles and pogo sticks. Of these, surf boards and skate boards enjoy the most popularity and have advanced to the status of sport. Unfortunately surf boards, require water with a rolling surf which limits their appeal to areas of the country which allow access to the sea. Skateboards are best suited to areas which provide inclines. Concern over pedestrian safety has caused skateboards to be outlawed in many areas.

Therefore a need exists to furnish a recreational balance game which can be enjoyed without geographical restrictions.

DESCRIPTION OF THE PRIOR ART

Applicant is aware of the following U.S. Patents concerning balancing walking devices.

| US PAT. No. | Inventor | Issue Date | Title |
|---|---|---|---|
| 2,930,613 | Katz | 10-13-58 | TOY FOR BALANCING AND WALKING |
| Des. 189,826 | Katz | 02-28-61 | TOY FOR BALANCING AND WALKING |
| 3,108,802 | Sundquist | 12-06-61 | TEETER SCOOTER |
| 3,854,717 | Judkins | 12-17-74 | AMBULATORY AMUSEMENT AND EXERCISE DEVICE |

Katz U.S. Pat. No. 2,930,613 teaches a toy for balancing and walking. This toy is configured with a beam attaching two platforms to provide support for the feet. The legs are stationary with non-skid caps.

Katz U.S. Design Pat. No. 189,826 teaches an ornamental toy design for balancing and walking. This design is an outgrowth of Katz original utility patent which lends itself to be molded as a single unit.

Sundquist U.S. Pat. No. 3,108,802 teaches a teeter scooter. This teeter scooter is configured with a horizontally extending frame to which two circular support discs are attached so that they rotate about an axis attached to the top of the frame. The legs which provide the support for the unit are hinged at the bottom of the frame.

Judkins U.S. Pat. No. 3,854,717 teaches an apparatus for ambulatory amusement and exercise. This device is configured with two shoe holders mounted to a semicircular rod and two legs mounted, perpendicularly to the semicircular rod.

Unlike the present invention none of the patents mentioned above show a support pad designed so that the entire apparatus can be swiveled easily about the pad of the unit. Further all of the patents mentioned above show an apparatus with foot support units extending from a narrower frame. The present invention uses a board of uniform width which allows for greater movement of the weight of the user with respect to the support feet which facilitates its use. Finally none of the patents show an associated rope or make any reference to any means for imparting a bouncing movement to the unit.

SUMMARY OF THE INVENTION

The invention provides a sports board apparatus having two resilient swivel pads which allow bouncing. During normal operation, the operator jumps or steps onto the unit so that his feet rest on the spaced non-skid surfaces. Through adjustment of body weight the user can balance the sports board on its two downwardly projecting members or pads. Then by shifting the user's body weight, the entire weight of the sports board and the user is applied to one of the pads and swiveled. The second pad is raised off the ground and the entire board is reoriented about the swivel point. This action allows a user to walk the sports board as the board is alternately swiveled about the vertical axis of each pad in a manner allowing linear movement of the sports board and user.

The sports board as configured with the cord and rubber or elastomeric pads can be bounced in a similar manner to a pogo stick. Use of the cord allows the sports board to remain in contact with the user's feet even after the user propels himself into the air. Additionally, in other stunts utilizing the sports board the cord allows the user to keep the sports board in a tight proximity with the user in situations where the user's movement would tend to separate the board from the user.

The present invention is particularly useful in games of skill where the participants are required to keep the tilt walker sports board within a given path or course. Lines can be drawn on the pavement or a flat area of ground where the user would be required to keep the sports board within the given boundaries. Here, it is possible to have the path become extremely narrow where the only way to stay within the given boundary is to rotate the sports board 180 degrees on one of its swivel pads. It is also possible to configure a course for use with the sports board on which a user is required to jump the sports board over a small restricted area of ground.

The invented apparatus consists of an elongated board having a pair of downwardly projecting members spaced apart, and on the inboard side of the elongated board. Each of these members is fitted with a pad made of a rubber or elastomeric material which is configured to rotate about an axis.

OBJECTS OF THE INVENTION

The principal object of the invention is to provide an improved sports device requiring skill and balance.

A further object of this invention is to provide a sports device which can be enjoyed in a restrictive area.

Another object of this invention is to provide a sports device which can be enjoyed indoors as well as outdoors.

A further object of this invention is to provide an apparatus for a sports device which can be bounced.

Another object of the invention is to provide a sports apparatus which facilitates turns and spins.

BRIEF DESCRIPTION OF THE DRAWINGS

The foregoing and other objects will become more readily apparent by referring to the following detailed description and the appended drawings in which.

DETAILED DESCRIPTION

Figure 1:
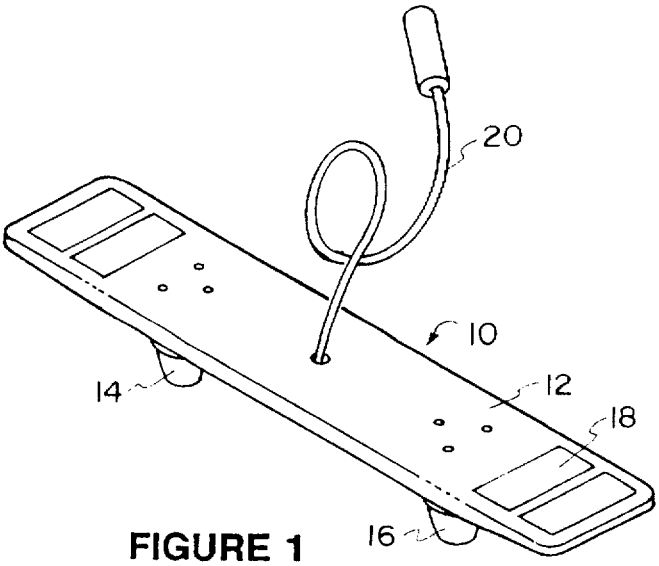
FIG. 1 is an isometric view of the invented Sports Tilt Walker™ sports board.
Figure 2:
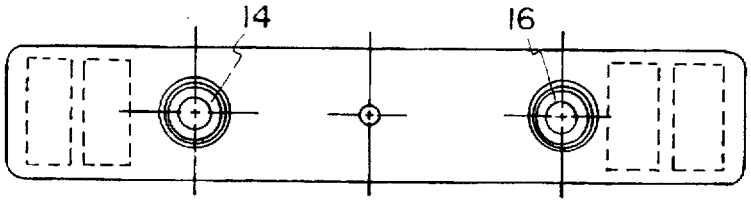
FIG. 2 is a bottom view of the invented Sports Tilt Walker™ sports board.

Referring now to the drawings, and particularly to FIG. 1, the invented Sports Tilt Walker™ Sports Board device 10 includes an elongated base member 12 having a pair of downwardly projecting members 14 and 16, which are spaced apart, and on the inboard side of non-skid material 18 affixed to the top of the base. The board member 12 can be made of wood, composition board, plastic, aluminum, fiberglass, or a composite material. Edges of the member 12 may be tapered to improve safety. A rope or cord 20 can be placed at the center of the unit to enable the user to use the device to perform tricks. Generally, the rope 20 is affixed into a centrol hole in the elongated base. Trick can be performed with or without use of rope.

Figure 6:
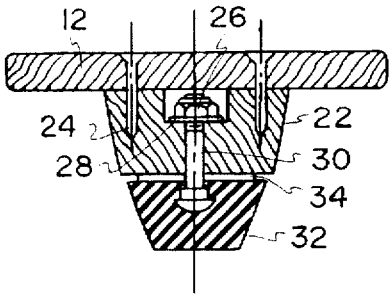
FIG. 6 is a cross sectional view of one of the feet of the invented Sports Tilt Walker™ sports board.

The downwardly projecting foot members 14 and 16 are shown in greater detail in FIG. 6. Generally cylindrical member 22 is fastened to the elongated board 12 by several screws 24. The member 22 is provided with a central orifice of two different diameters in axial alignment. Next to the elongated board 12, the orifice is larger. This is to accommodate a lock nut 26 and washer 28, which act as an axle retainer. A carriage bolt 30 is secured at one end by lock nut 26, the other end is secured to rubber pad 32. Between the cylindrical member 22 and rubber pad 32 a nylon flat washer 34 is slidably affixed about carriage bolt 30. The cylindrical member 22 provides a physical limitation to flat washer 34. At this point cylindrical member 22 is fitted with a small orifice which carriage bolt 30 passes through. The carriage bolt acts as an axle allowing free rotation of the elongated member about rubber pad 32.

In operation, the user mounts or jumps onto the elongated board 12 so that his feet rest on the spaced non-skid surfaces 18, and by adjusting his weight properly balances the sports board on its two downwardly projecting members 14 and 16.

ALTERNATIVE EMBODIMENTS

Figure 7:
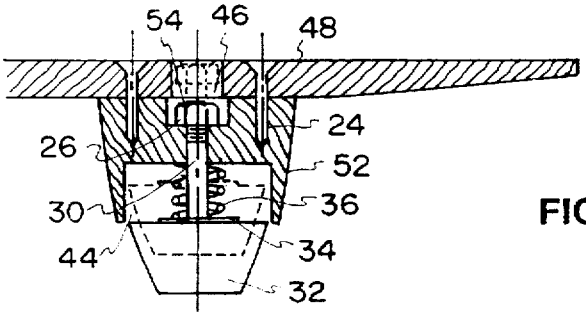
FIG. 7 is a cross sectional view of an alterative embodiment of one of the feet of the invented Sports Tilt Walker™ sports board.
Figure 8:
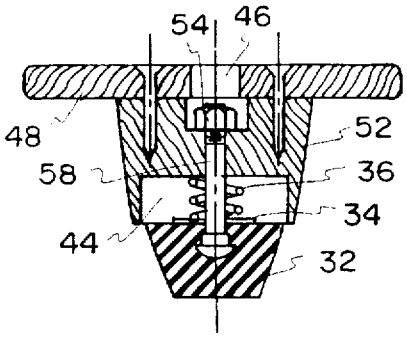
FIG. 8 is a cross sectional view of an alterative embodiment of one of the feet of the invented Sports Tilt Walker™ sports board.
Figure 9:
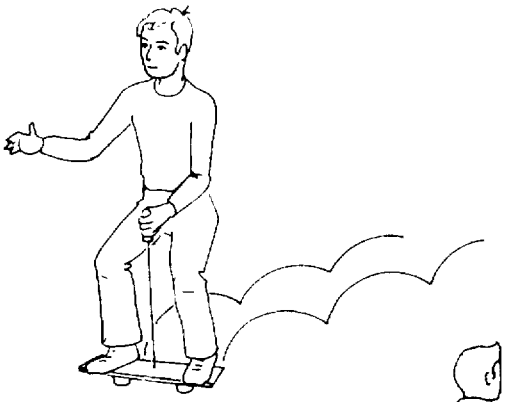
FIG. 9 is an isometric view of the invented Sports Tilt Walker™ sports board as used for bouncing.

The downwardly projecting members 14 and 16 can also be configured with a biasing means or spring 36 mounted between modified generally round member 52 and the rubber bumper 32, FIG. 7. Modified round member 52 is provided with two central and axial cylindrical orifices 44 and 54. Screws 24 attach the modified round member 52 to the horizontal base of the sports board 48 so that enlarged cylindrical orifice 54 is located near the horizontal base of sports board 48 and cylindrical orifice 44 is located furthest from the horizontal base of sports board 48. A smaller cylindrical 58 orifice connects cylindrical orifice 54 and cylindrical orifice 44 and is configured to accept a carriage bolt 30. The carriage bolt fits tightly inside of orifice 58 providing stability in various directions that the sports board may be stressed. At the threaded portion of carriage bolt 30 a locknut 26 is fastened. The carriage bolt extends through the small cylindrical orifice which connects cylindrical orifice 54 with cylindrical orifice 44. The portion of the carriage bolt 30 which extends into the larger cylindrical orifice 44 is fitted with a spring 36. The head of the carriage bolt 30 is embedded in the rubber pad 32. Flat washer 34 is held against rubber pad 30 by the force of spring 36.

The horizontal sports board 48 is provided with 2 cylindrical orifices 46 directly above downwardly projecting foot members 14 and 16. When a user is standing on the sports board of this configuration locknut 26 extends through cylindrical orifice 46 and is flush with the top of the horizontal sports board 48. Spring 36 is compressed within cylindrical orifice 44 storing potential energy. The rubber pad 32 moves up into cylindrical orifice 44. When weight is removed from this area of the sports board spring 36 will decompress moving rubber pad 32 out from cylindrical orifice 44 and the locknut 26 travels through cylindrical orifice 46 and sports board 48 down into cylindrical orifice 54 modified cylindrical member 52 until it meets the solid material which comprises cylindrical member 52. With this configuration, the user can more easily bounce the board in a similar manner to a pogo stick while still retaining the rotatably of the board about each of its rubber pads 32.

Figure 10:
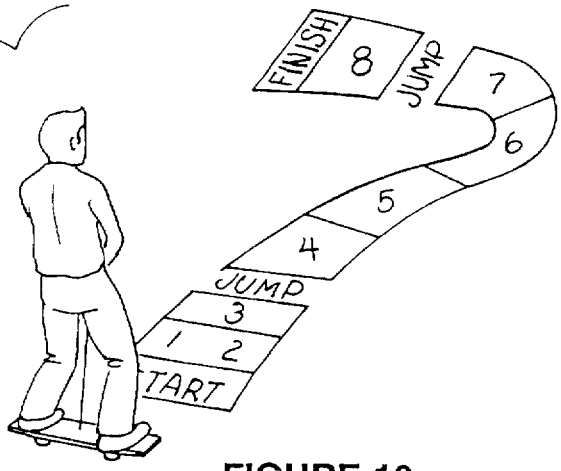
FIG. 10 is an isometric view of a game of skill utilizing the invention.

FIG. 10 shows a game in which the feet of the sports board follow the numbered squares and the player jumps where indicated.

Figure 11:
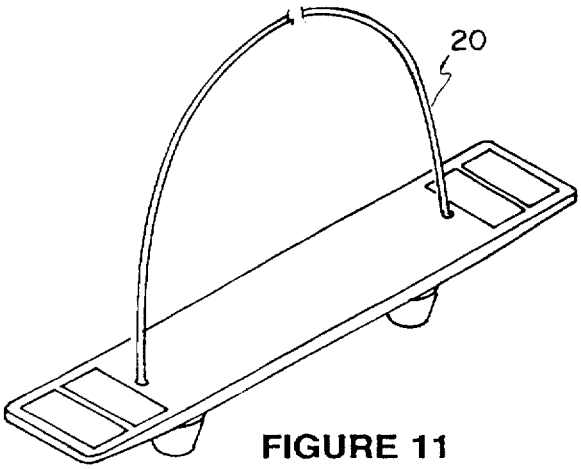
FIG. 11 is an isometric view of an alternative embodiment of the invention having a rope attached at two points to the sports board.
Figure 12:
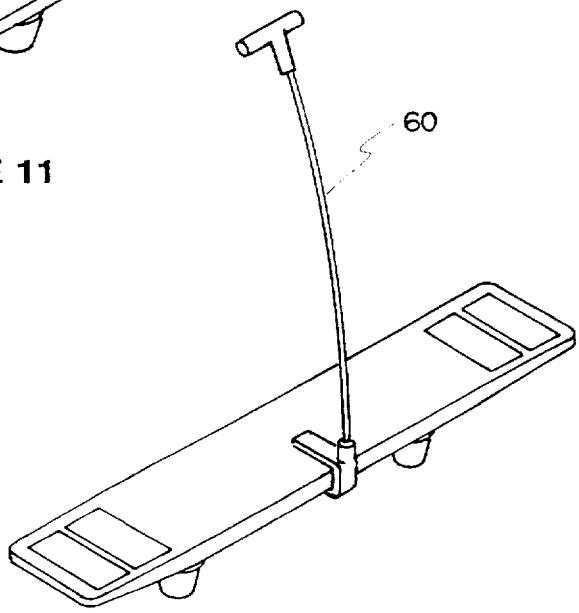
FIG. 12 is an isometric view of an alternative embodiment of the invention with an associated flexible J hook.
Figure 13:
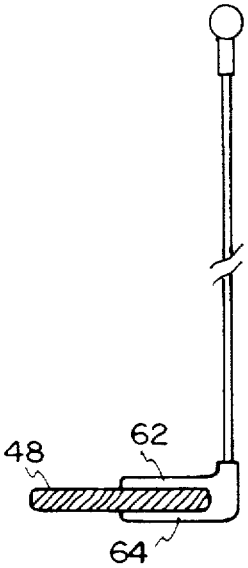
FIG. 13 shows one embodiment of the associated J hook.
Figure 14:
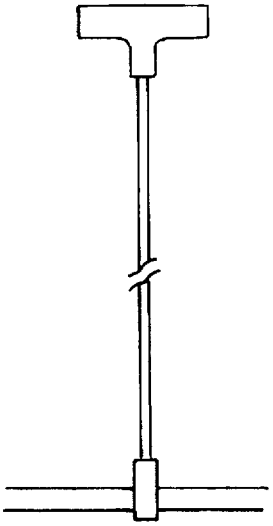
FIG. 14 shows another embodiment of the J hook.
Figure 15:
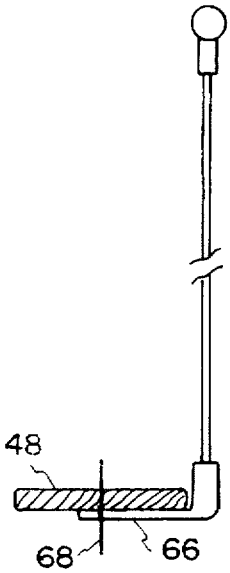
FIG. 15 shows an alternative embodiment of the J hook.

The rope or cord 20 can be connected to either one or two spots on the elongated board member, FIG. 11. A dual connection allows the user to lift up one of the ends of the board. Additionally the board can be configured with a flexible J pole 60 or hook, FIG. 12, to facilitate its use while performing "tricks". The J hook can have any of the configurations shown in FIGS. 13 through 15. It can have two tines 62,64 for engaging both the upper and lower surfaces of board 48, or it can be provided with only one long tine 66 which extends beyond the longitudinal centerline 68 when engaging the sports board 48.

Figure 16:
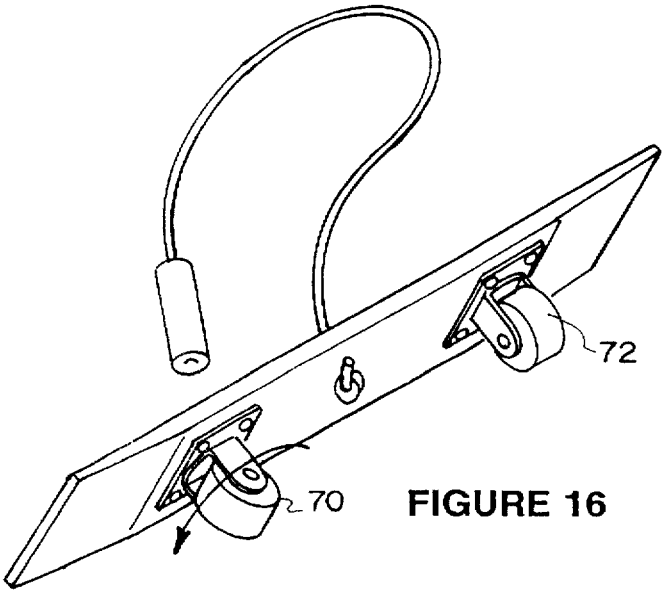
FIG. 16 shows the tilt walker sports board fitted with caster wheels.
Figure 17:
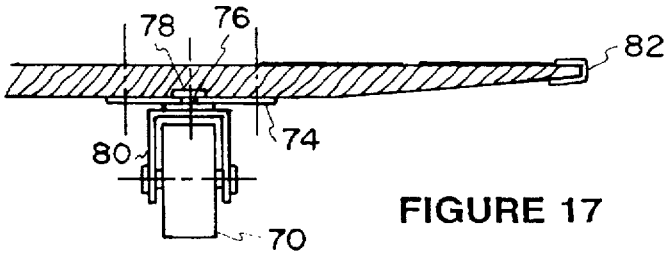
FIG. 17 is a cross sectional view of FIG. 16 showing the caster wheel in greater detail.

The alternative embodiment shown in FIGS. 16 and 17 includes caster style wheels 70,72 in place of the pivotal feet. In this embodiment each of the downwardly projecting members 74 house a vertical axle 76 and an axle retainer 78, and a caster 80 and associated caster wheel 70 are rotatably fixed to the axle. Thus, the tilt walker sports board is still pivotable about either axle, but is also capable of performing like a skate board. Alternatively, the caster wheels 70,72 can be made of rubber or other elastomeric material, which will allow the user to bounce the sports board.

FIG. 17 also illustrates an end cap 82, which may a wear resistant end shield of any desired material.

Figure 3:
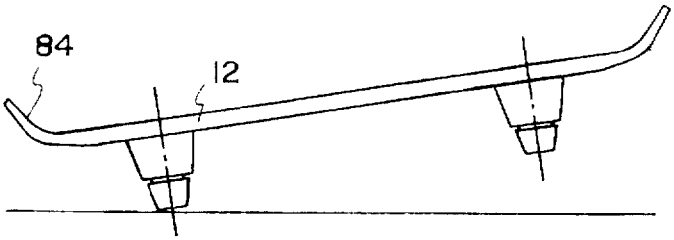
FIG. 3 is a front view of the invented Sports Tilt Walker™ sports board.
Figure 4:
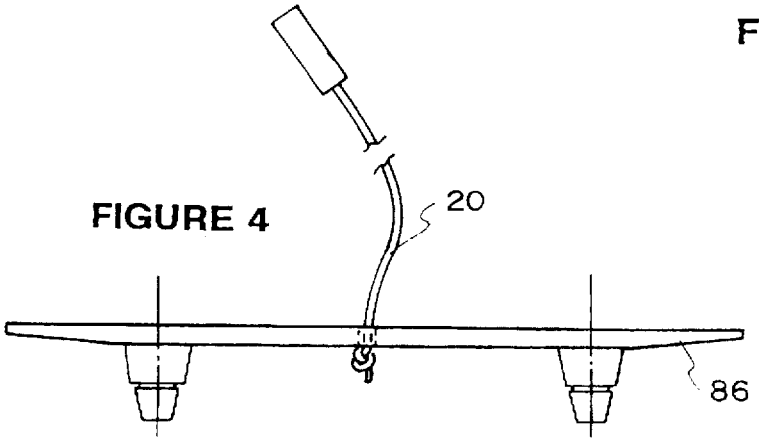
FIG. 4 is a front view of the invented Sports Tilt Walker™ sports board.
Figure 5:
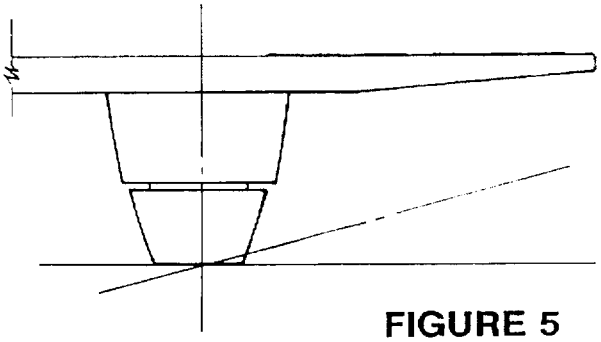
FIG. 5 is a sectional front view of the invented Sports Tilt Walker™ sports board showing one of the downwardly projecting members.

As shown in FIG. 3, the ends 84 may be inclined upwardly. The underside of board can be provided with an end taper 86 as shown in FIG. 4.

SUMMARY OF THE ACHIEVEMENT OF THE OBJECTS OF THE INVENTION

From the foregoing, it is readily apparent that I have invented an improved apparatus for a recreational device of skill and balance. By using my apparatus, operators will be able to simulate a walking type movement in addition to a bouncing motion. The rotatable pads of the apparatus in conjunction with the use of the rope allow a wide range of motion of the device which heretofore has been unknown in similar devices.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A recreational device comprising:

an elongated generally flat base having an upper and lower surface, a right end, a left end, a width and a center;

said elongated base being provided with a pair of apertures spaced from the ends and spaced apart;

a pair of downwardly projecting members, mounted under said apertures on said lower surface of said elongated base;

each of said downwardly projecting members housing a vertical axle and axle retainer;

said axle configured with a head member;

a foot rotatably fixed to said axle;

a spring engaged about said axle in contact with said foot and said upper portion of said downwardly projecting member;

the elongated base being pivotal about either foot; and said pair of downwardly projecting members further having means for accommodating said feet therein and that upon compression of said spring, said foot moves upward into said downwardly projecting member thereby moving said head member of said axle into said apertures so that it is flush with said upper surface of said elongated base.

2. A device according to claim 1 further comprising a rope attached to said center of said elongated base.

3. A device according to claim 1 further comprising a pair of footrests configured on said top of said elongated member, each footrest spaced in between said right end and a projecting member and said left end and a projecting member of said elongated member, spaced apart.

4. A device according to claim 1 wherein said elongated base is of uniform width and is configured with a flush upper surface.

5. A device according to claim 1 wherein each said foot is made of an elastomeric material.

6. A device according to claim 1 further comprising non-skid strips fixed to said footrests.

* * * * *